US008671594B2

(12) United States Patent
Ortley et al.

(10) Patent No.: US 8,671,594 B2
(45) Date of Patent: Mar. 18, 2014

(54) ARTICLE OF FOOTWEAR WITH TRACTION MEMBERS HAVING A LOW PROFILE SOLE

(75) Inventors: David Ortley, Encinitas, CA (US); Marco Aurelio Grott, San Marcos, CA (US)

(73) Assignee: Taylor Made Golf Company, Carlsbad, CA (US)

( * ) Notice: Subject to any disclaimer, the term of this patent is extended or adjusted under 35 U.S.C. 154(b) by 904 days.

(21) Appl. No.: 12/664,604

(22) PCT Filed: Jun. 20, 2008

(86) PCT No.: PCT/US2008/007678

§ 371 (c)(1),
(2), (4) Date: May 13, 2010

(87) PCT Pub. No.: WO2008/156825

PCT Pub. Date: Dec. 24, 2008

(65) Prior Publication Data

US 2010/0212191 A1 Aug. 26, 2010

Related U.S. Application Data

(60) Provisional application No. 60/945,258, filed on Jun. 20, 2007.

(51) Int. Cl.

| | |
|---|---|
| ***A43B 5/00*** | (2006.01) |
| ***A43C 15/02*** | (2006.01) |
| ***A43C 15/16*** | (2006.01) |

(52) U.S. Cl.

CPC ..... *A43C 15/161* (2013.01); *A43C 15/168* (2013.01)

USPC ..... 36/134; 36/127; 36/66; 36/59 R; 36/67 D

(58) Field of Classification Search

USPC ..... 36/127, 134, 67 R–67 D, 59 C

See application file for complete search history.

(56) References Cited

U.S. PATENT DOCUMENTS

| | | | |
|---|---|---|---|
| 2,128,891 | A | 9/1938 | Barnes |
| 2,607,134 | A | 8/1952 | Langer |

(Continued)

FOREIGN PATENT DOCUMENTS

| | | | |
|---|---|---|---|
| JP | 2002-325604 | A | 11/2002 |
| JP | 2003-325205 | A | 11/2003 |

OTHER PUBLICATIONS

International Search Report for PCT/US2008/007678, mailed Sep. 29, 2008, 1 pg.

(Continued)

*Primary Examiner* — Jila M Mohandesi

(74) *Attorney, Agent, or Firm* — Sterne, Kessler, Goldstein & Fox P.L.L.C.

(57) ABSTRACT

An article of footwear with traction members, such as cleats or spikes, having a low profile sole providing increased stability to the wearer. The profile of a sole is the distance between the lasting line and the end of the traction members. This distance incorporates traction members, an outsole of the article of footwear having receptacles for receiving the traction members, and a lasting material located above the receptacles for attaching the sole to the upper. A lower profile may be achieved by reducing, for example, the height of the receptacle, through the use of new connection mechanisms and/or constructions.

8 Claims, 3 Drawing Sheets

(56) References Cited

U.S. PATENT DOCUMENTS

| | | | | | |
|---|---|---|---|---|---|
| 3,054,197 | A | | 9/1962 | Morgan et al. | |
| 3,566,489 | A | | 3/1971 | Morley | |
| 3,672,077 | A | | 6/1972 | Coles | |
| 4,035,934 | A | | 7/1977 | Hrivnak | |
| 4,633,600 | A | | 1/1987 | Dassler et al. | |
| 4,644,672 | A | | 2/1987 | Dassler et al. | |
| 4,833,796 | A | | 5/1989 | Flemming | |
| 5,259,129 | A | | 11/1993 | Deacon et al. | |
| 5,367,793 | A | | 11/1994 | Deacon et al. | |
| 5,377,431 | A | | 1/1995 | Walker et al. | |
| 5,475,937 | A | | 12/1995 | Korsen | |
| 5,505,012 | A | | 4/1996 | Walker et al. | |
| 5,617,653 | A | | 4/1997 | Walker et al. | |
| 5,628,129 | A | | 5/1997 | Kilgore et al. | |
| 5,638,615 | A | | 6/1997 | Korsen | |
| 5,743,029 | A | | 4/1998 | Walker et al. | |
| 5,782,017 | A | | 7/1998 | Ortscheid | |
| 5,848,482 | A | * | 12/1998 | Bathum | 36/127 |
| 5,860,228 | A | * | 1/1999 | Bathum | 36/127 |
| 5,875,572 | A | * | 3/1999 | Redburn | 36/134 |
| 5,901,473 | A | | 5/1999 | Heifort, IV | |
| 5,956,871 | A | | 9/1999 | Korsen | |
| 5,960,568 | A | | 10/1999 | Bell et al. | |
| 5,987,784 | A | | 11/1999 | Bignell | |
| 6,009,640 | A | | 1/2000 | Deacon et al. | |
| 6,108,944 | A | | 8/2000 | Savoie | |
| 6,154,984 | A | | 12/2000 | Adam | |
| 6,260,292 | B1 | | 7/2001 | Swedick et al. | |
| 6,327,797 | B1 | | 12/2001 | Deacon et al. | |
| 6,354,021 | B1 | | 3/2002 | Deacon et al. | |
| 6,442,872 | B1 | | 9/2002 | Liao | |
| 6,463,681 | B1 | | 10/2002 | Savoie | |
| 6,513,266 | B1 | | 2/2003 | Ijiri | |
| 6,601,322 | B2 | | 8/2003 | Hsiao | |
| 6,675,505 | B2 | | 1/2004 | Terashima | |
| 6,722,061 | B2 | | 4/2004 | Auger et al. | |
| 6,748,677 | B2 | | 6/2004 | Briant et al. | |
| 6,823,613 | B2 | * | 11/2004 | Kelly et al. | 36/134 |
| 6,826,854 | B2 | * | 12/2004 | Ijiri | 36/134 |
| 6,904,707 | B2 | * | 6/2005 | McMullin | 36/127 |
| 6,941,684 | B2 | | 9/2005 | Auger et al. | |
| 6,983,556 | B2 | | 1/2006 | McMullin | |
| 7,007,413 | B2 | * | 3/2006 | McMullin | 36/134 |
| 7,047,675 | B2 | * | 5/2006 | Briant et al. | 36/134 |
| 7,073,280 | B2 | | 7/2006 | Terashima | |
| 7,086,182 | B2 | | 8/2006 | Deacon et al. | |
| 7,107,708 | B2 | * | 9/2006 | Kelly et al. | 36/134 |
| 7,249,428 | B1 | * | 7/2007 | Burella | 36/134 |
| 7,774,958 | B2 | * | 8/2010 | Carruthers | 36/134 |
| 2002/0133978 | A1 | | 9/2002 | Liao | |
| 2002/0178613 | A1 | | 12/2002 | Williamson et al. | |
| 2004/0194351 | A1 | | 10/2004 | Gallegos | |
| 2005/0278981 | A1 | | 12/2005 | McMullin | |
| 2006/0179688 | A1 | | 8/2006 | Briant et al. | |
| 2006/0277800 | A1 | | 12/2006 | Santos et al. | |

OTHER PUBLICATIONS

Notice of Reasons for Rejection mailed Feb. 25, 2013 for Japanese Patent Application No. 2010-513251, 7 pages.

* cited by examiner

ARTICLE OF FOOTWEAR WITH TRACTION MEMBERS HAVING A LOW PROFILE SOLE

BACKGROUND OF THE INVENTION

1. Field of the Invention

The present invention is related to footwear and more particularly an article of footwear having an associated traction member, such as a shoe cleat, and receptacle system.

2. Background Art

The need for providing improved traction members for the soles of shoes on turf surfaces is well known, particularly in the field of sports such as football, baseball, soccer, and golf. In some sports, particularly golf, the need for providing improved traction members, which include cleats, must be considered in combination with limiting the wear and tear on the playing turf that can be caused by the traction elements.

In recent years, there has been a change from using penetrating metal spikes for golf shoes to removable plastic cleats that are more turf-friendly and less harmful to clubhouse floor surfaces. Traction and stability are important factors when designing such cleated shoes.

BRIEF SUMMARY OF THE INVENTION

Disclosed herein is a cleated shoe having a low profile to increase stability and allow a wearer's feet to be closer to the ground. By reducing the distance between the lasting line and the end of the traction members, the wearer is afforded a more responsive feel for the ground during use.

In one embodiment, a lower profile cleated shoe may be produced by reducing the height of a receptacle for a traction member, by modifying the retaining mechanism of the receptacle and of the traction member. For example, traction member may snap into the receptacle rather, such that prongs disposed within the receptacle lock with teeth of the traction member.

BRIEF DESCRIPTION OF THE DRAWINGS/FIGURES

DETAILED DESCRIPTION OF THE INVENTION

Figure 1:
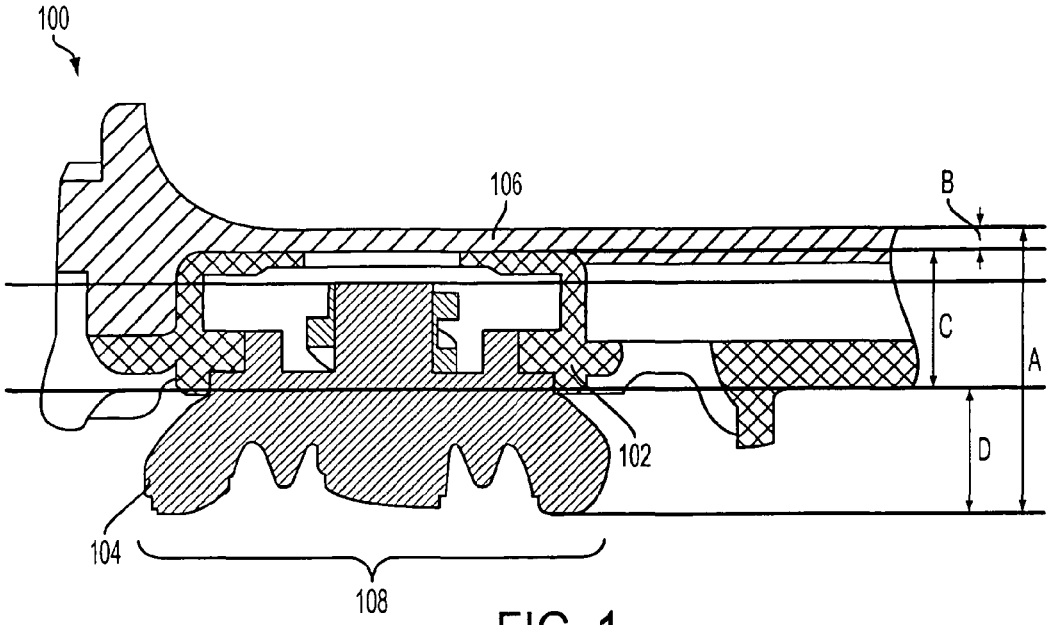
FIG. 1 is a cross-sectional view of a portion of a sole of a conventional article of footwear.

The present invention is now described with reference to the Figures, in which like reference numerals are used to indicate identical or functionally similar elements. While specific configurations and arrangements can be used without departing from the spirit and scope of the invention, it will be apparent to a person skilled in the relevant art that this invention can also be employed in other applications.

Stability is an important factor for articles of footwear having traction members. One factor affecting stability is the distance between the lasting line (where the upper of the shoe is connected to a lasting board) and the end of the traction members. Typically, this distance incorporates the traction member, such as a cleat or spike, an outsole of the article of footwear having a receptacle for receiving the traction member, and the lasting line located above the receptacle for attaching the sole to the upper.

FIG. 1 illustrates an example of an article of footwear having a conventional sole 100 with a plurality of receptacles 102, each of which retains a traction member 104. Traction member 104, for example a shoe cleat, such as a golf shoe cleat, is screwed into receptacle 102. The profile of sole 100 of such an article of footwear may be measured from a lasting line, which is the interface of the sole 100 with an upper (not shown), to the end of traction member 104. Therefore, the profile includes lasting material 106, which connects sole 100 to the upper, receptacle 102, and traction member 104. The profile is represented by measurement A in FIG. 1 and is typically about 18.2 mm. Measurement B in FIG. 1 represents the thickness of lasting material 106 and is typically about 1.2 mm. Measurement C in FIG. 1 represents the height of receptacle 102 and is typically about 10.0 mm. Measurement D in FIG. 1 represents the height of a ground engaging portion 108 of traction member 104 and is typically about 7.0 mm. An example of such a construction is the type sold under the mark FAST TWITCH by Trisport Ltd.

Figure 2:
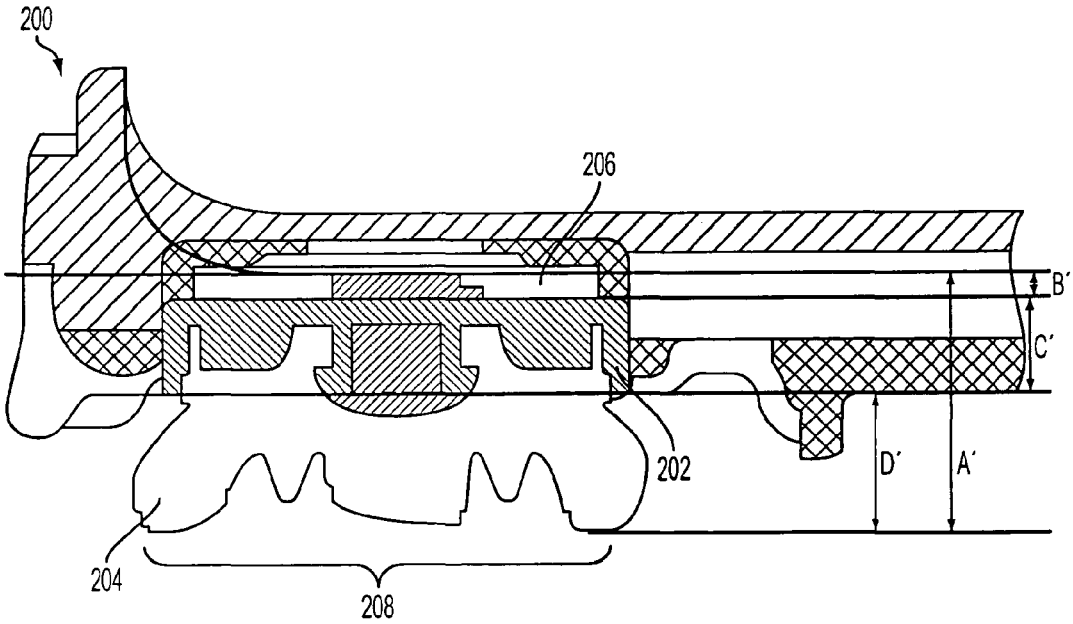
FIG. 2 is a cross-sectional view of a portion of a sole of an article of footwear with an exemplary low profile sole superimposed over FIG. 1.

FIG. 2 shows a sole 200 of an article of footwear according to the present invention superimposed over the conventional sole shown in FIG. 1. As shown in FIG. 2, a profile A' of sole 200 of an article of footwear according to the present invention may be reduced by minimizing the height C' of receptacle 202. Profile A' may be reduced to about 13.2 mm, measurement B', the thickness of lasting material 206, may be about 1.2 mm, measurement C' may be reduced to about 5.0 mm, and measurement D', the height of a ground engaging portion 208 of traction member 204, may be about 7.0 mm. These measurements are merely exemplary.

Figure 3:
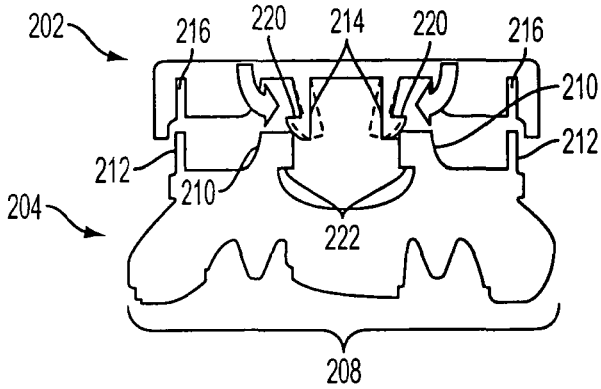
FIG. 3 is a cross-sectional view of an exemplary receptacle and an exemplary traction member for use in a low profile sole.
Figure 4:
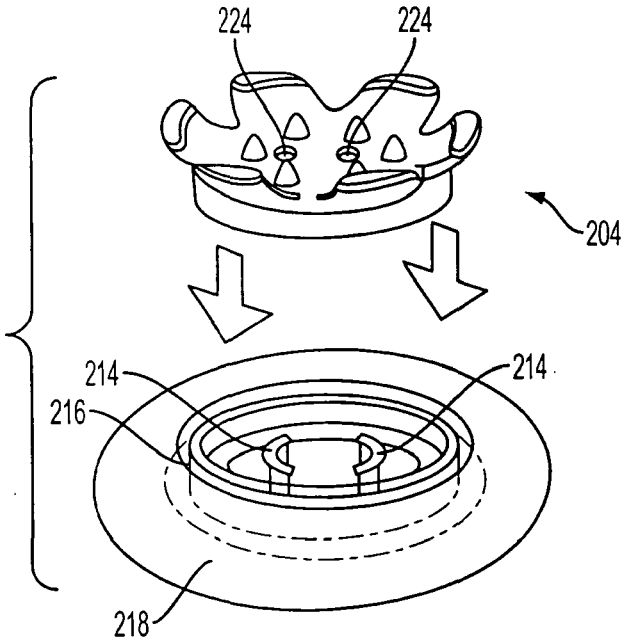
FIG. 4 is a perspective view of an exemplary receptacle and an exemplary traction member for use in a low profile sole.

One exemplary manner for reducing the height of receptacle 202 is by modifying the retaining mechanism of receptacle 202 and of traction member 204. For example, traction member 204 may snap into receptacle 202, as is illustrated in FIGS. 3-4. Traction member 204 may have teeth 210 and may have an extension 212 extending around a periphery of traction member 204. Receptacle 202 may have prongs 214 that lock with teeth 210 of traction member 204. There may be a channel 216 between receptacle 202 and an outsole base 218 that receives extension 212 of traction member 204. When traction member 204 is inserted into receptacle 202, teeth 210 push prongs 214 inward. After traction member 204 is inserted, teeth 210 return to their original position such that an edge 220 of prongs 214 catch on a ledge 222 of teeth 210, thereby retaining traction member 204 in receptacle 202.

Figure 5:
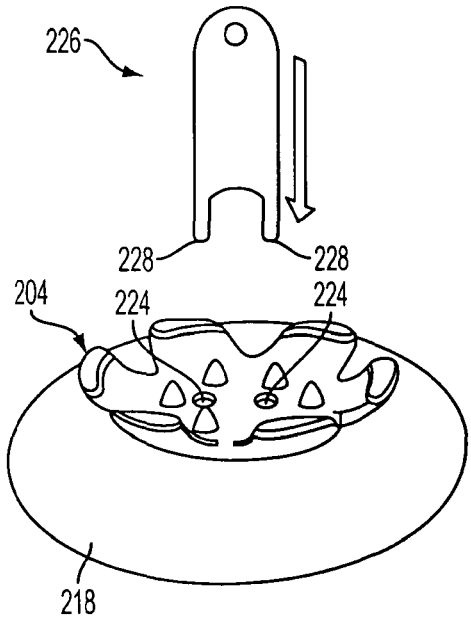
FIG. 5 is a perspective view of an exemplary removal tool for removing the exemplary traction member from the exemplary receptacle.

As shown in FIG. 5, traction member 204 may have holes 224 in ground engaging portion 208 that allow a removal tool 226 to access prongs 214 for removing traction member 204 from receptacle 202. Ends 228 of removal tool 226 are sized and shaped to fit into holes 224 in traction member 204 and to press edges 220 of prongs 214 inward to disengage edges 220 from ledges 222 of teeth 210, thereby allowing traction member 204 to be removed from receptacle 202.

Other retaining mechanism arrangements may also be contemplated to reduce the height of receptacle 202. One arrangement, for example, is a low profile screw in cleat having fewer threads than a conventional screw in cleat while still providing adequate engagement.

Another manner for providing a lower profile cleated shoe is to reduce the thickness of the material about the receptacle.

Ground engaging portion 208 of traction member 204 may have any design that provides adequate traction for the intended use of the article of footwear. For example, ground engaging portion 208 may have the design and features disclosed in U.S. Patent Application Publication 2007/0062070, published Mar. 22, 2007, which is hereby incorporated by reference in its entirety. Such a construction consists of traction members 204, such as cleats, having large traction elements and small traction elements. In use, several cleats are typically secured to the sole of a user's shoe. As the user steps down, pressure is applied to the cleat and the large traction elements are able to flex upwardly (i.e., generally toward the sole of a shoe when the cleat is attached). This flexing decreases both wear on the large traction elements and damage to turf. It is also believed that the flexing may increase the traction in some situations, such as by temporarily trapping grass blades between the cleat and the sole of the shoe. On hard surfaces such as many tee boxes where the large traction elements may not provide sufficient traction, the large traction elements flex upwardly, allowing the small traction elements to engage such hard surfaces. Moreover, the flexing of the large traction elements as well as the presence of the small traction elements may increase traction in uneven terrain. Accordingly, it is believed that the combination of the large traction elements and the small traction elements can provide greater traction in a wider variety of terrains (such as tee boxes, roughs, greens, fairways, etc.) than cleats with only a single type of traction element. Additionally, the improved traction is achieved without any need for the user to adjust the cleats when encountering different types of terrain. However, many of the features described herein could be used with a cleat having only a single type of traction element.

Traction members 204 may be made with standard injection molding techniques or other techniques known to those skilled in the relevant art.

A lower profile cleated shoe may also be produced by reducing the height of the traction member.

Combinations of the techniques discussed above may also be employed to produce a low profile cleated shoe.

By reducing the height of the receptacle, through the use of new connection mechanisms and/or constructions, as described above, a lower profile cleated shoe may be provided having increased stability. A lower profile allows a wearer's feet to be closer to the ground, which gives the wearer a more responsive feel for the ground during use.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. An article of footwear comprising:

a lasting material;

a receptacle connected to the lasting material, the receptacle comprising a snap fit retaining mechanism; and a traction member adapted to snap into the snap fit retaining mechanism of the receptacle, wherein the snap fit retaining mechanism comprises a movable first prong, wherein the traction member comprises a tooth engageable with the movable first prong, wherein the traction member further comprises a hole that allows access to the movable first prong, and wherein the hole is sized to allow an end of a removal tool to pass therethrough to directly contact the movable prong and disengage the tooth and the movable first prong.

2. The article of footwear of claim 1, wherein the snap fit retaining mechanism further comprises a movable second prong, the tooth is a first tooth, and the traction member further comprises a second tooth engageable with the movable second prong.

3. The article of footwear of claim 1, wherein:

the lasting material comprises a first surface and a second surface;

the receptacle is connected to the second surface of the lasting material;

the traction member further comprises a ground engaging portion; and a height of an assembly comprising the lasting material, the receptacle, and the traction member measured from the first surface of the lasting material to the ground engaging portion of the traction member is less than or equal to about 13.2 mm.

4. The article of footwear of claim 1, further comprising an upper, wherein the lasting material is attached to the upper.

5. The article of footwear of claim 1, wherein:

the movable first prong has a first edge; and the receptacle comprises a movable second prong having a second edge;

the tooth is a first tooth having a first ledge;

the traction member further comprises a second tooth having a second ledge; and the traction member is configured to be retained in the receptacle such that when the traction member is snapped into the receptacle the first tooth moves the first prong and the second tooth moves the second prong until the first and second prongs snap back to their original position such that the first edge is held in place by the first ledge and the second edge is held in place by the second ledge.

6. The article of footwear of claim 5, wherein:

the hole is a first hole;

the traction member further comprises a second hole that allows access to the movable second prong; and the first and second holes are sized to allow ends of a removal tool to pass therethrough for removing the traction member from the receptacle.

7. The article of footwear of claim 5, further comprising an upper, wherein the lasting material is attached to the upper.

8. The article of footwear of claim 1, wherein a height of the receptacle is less than or equal to about 5.0 mm.

* * * * *